United States Patent [19]

Keulertz et al.

[11] 4,131,240

[45] Dec. 26, 1978

[54] EXPANDABLE MANDREL REEL

[75] Inventors: Werner Keulertz, Duisburg; Karl-Heinz Wessel, Dinslaken, both of Germany

[73] Assignee: DEMAG, Aktiengesellschaft, Duisburg, Germany

[21] Appl. No.: 842,369

[22] Filed: Oct. 14, 1977

[30] Foreign Application Priority Data

Oct. 25, 1976 [DE] Fed. Rep. of Germany ..... 2548197

[51] Int. Cl.[2] ..... B65H 75/18

[52] U.S. Cl. ..... 242/72.1

[58] Field of Search ..... 242/72, 72.1, 78.1

[56] References Cited

U.S. PATENT DOCUMENTS

| | | | |
|---|---|---|---|
| 3,104,849 | 9/1963 | Bond | 242/72.1 |
| 3,298,627 | 1/1967 | Sturdy | 242/72.1 |
| 3,300,157 | 1/1967 | Koreishi | 242/72.1 X |
| 3,666,194 | 5/1972 | Gosnell | 242/72.1 |

*Primary Examiner*—Edward J. McCarthy

*Attorney, Agent, or Firm*—Mandeville and Schweitzer

[57] ABSTRACT

The invention refers to an expandable mandrel reel to coil strip-like rolling material, particularly hot strip, with an inner mandrel shaft, as well as several expanding segments affixed to the latter. The segments are spread by activating a tie rod, and are supported on several wedge faces on the mandrel shaft and rising in the longitudinal direction of the shaft. Means are provided for keeping the expanding segments in place against centrifugal force.

10 Claims, 3 Drawing Figures

EXPANDABLE MANDREL REEL

BACKGROUND OF THE INVENTION

Today's strip mill lines make great demands on the construction of strip coiling machines. They must be capable of coiling material qualities up to super-strong tube steel and high-duty steels at temperatures of up to 500° C approximately. Strip thicknesses of 20 to 25 mm are quite common. The widths of the strip approach roughly 2300 mm, with bundle weights being about 45 tons. If thinner strips are to be coiled, higher arrival speeds at the reel installation are necessary which may amount to 14 to 15 meters per second approximately. On the other hand, short periods are expected for the start-up of the mandrel reel, as well as for further acceleration, and also for deceleration of the mandrel with the fully coiled bundle. Furthermore, bundles must be clean and coiled with straight edges which is accomplished by securely held strip, secure tension on the strip, and good lead around the mandrel. The mandrel reel is expected to withstand high static periods at a maximum load of at least one million or more tons.

The known coiling machine connects the expanding segments with the body of the mandrel via levers, and uses a strain-stress rod to swivel all levers in and out, whereby the mandrel reel is expanded or contracted. This is to facilitate rotation of the mandrel reel with retracted expanding segments before the start of the actual reeling process to absorb the occurring centrifugal forces by way of the levers. Thus, the mandrel is no longer required to start coiling the strip in an expanded or pre-expanded condition, as was the case previously, but is expanded only after the mandrel has taken up the strip.

Today's technical standard makes great demands on the mandrel reel with respect to strip and coiling quality as well as high threading speed. In order to live up to these demands and to achieve secure strip tension the mandrel must be capable of ensuring exact slot setting of the coiling rollers by staying true to form.

STATEMENT OF THE INVENTION

The present invention is an improvement on an expandable mandrel reel which can withstand highest loads and speeds under an exact arrangement and mounting of the expanding segments, which facilitates the setting of differential expanded positions, and always securely holds the segments in any position and against centrifugal force at high rotational speeds. In order to insure a secure grip on the strip, the expanding area must be exactly contained so that an exact slot setting of the coiling rollers with respect to the mandrel takes place.

The invention achieves this by using as the mandrel shaft a body with a square base cross section and parallel lateral faces with attached centrally symmetrical extensions of rectangular cross section which form fins running along the mandrel shaft. The fins are provided on their flanks with lateral guides extending in expanding direction for the segments embracing the fin with appropriate recesses, so that the wedge faces used for expanding the segments are arranged directly on the mandrel shaft at right angles to the fin flanks with opposed cooperating wedge faces internally of each segment.

Based on the load capacity to be met, this arrangement gives an optimum cross section to the mandrel shaft providing the affixed segments with the broadest possible support in order to prevent tilting of the segments at extreme operating conditions. Particularly, the fins running along the mandrel shaft reinforcing the mandrel shaft cross section further, give exact and secure guidance to the segments. The wedge-shaped bearings for the segments are components of the mandrel shaft and guarantee excellent supporting conditions.

Another feature of the invention provides wear-resistant plates as lateral guides for the expanding segments affixed to the fin flanks. Due to enduring load capacity, the wear-resistant plates guarantee excellent form fit, and insure the long-lasting guide features of the segments.

Preferably, each lateral guide is provided with a spline into which a spring is inserted, and attached at the angle of the wedge faces, and which engages a corresponding spline on the expanding segment, thus maintaining the latter in any expanded position against centrifugal force. By means of the spring, the segment is simultaneously clenched with the mandrel shaft so that not only exact guidance in the direction of the wedge faces is guaranteed, but also a steady hold is exerted on the segments over the entire expanding area.

Another feature of the invention includes holding the segments at the mandrel bearing end by means of removable clamps which, on the side facing the segment, are provided with a guide face arranged at the angle of the wedge faces, such guide face permitting expansion of the segments, while resting on an identical guide face at the outer circumference of the expanding segment.

Preferably, these clamps are embraced by a retaining ring. The proposed clamps serve for easy dismantling of the segments for exchange or repair purposes and furthermore represent a secure mounting against centrifugal force.

For the purpose of setting the segments at the various expanded positions, the front end of the tie rod is provided with a radially expanding star unit which engages segment pockets in the inner circumference of the segments in the radial direction. Expansion can be effected by means of known expanding cylinders, whereby the entire construction of the mandrel permits utilization of expanding cylinders capable of any number of strokes. For example, the cylinder can pre-expand, re-expand, fully expand, and be designed for additional emergency expansion. This guarantees a secure grasp and a tightly coiled strip for any material quality.

In accordance with the invention, the segments are held at the end facing away from the mandrel bearing by an annular crown piece whose inner circumference facing the segments is provided with guide faces at the angle of the wedge faces for engaging identical guide faces resting at the outer circumference of the segments. If necessary, it is advantageous to design the annular crown piece to receive a step bearing. This arrangement, together with the clamping of the segments at the other end of the mandrel, results in a complete guide which is, nevertheless, only screwed on and permits simple assembly and dismantling. To this end, the segments are only slipped on to the guide faces and/or inserted into the guide spline. The mandrel head, with centering and screw connection, forms a unit with the mandrel shaft, such construction further increasing its effectiveness by simultaneously accommodating the step bearing at the head or crown piece to carry heavy bundles. Another detail of the invention provides all guide faces with antifriction material, such as special bronze.

This coiling mandrel construction has a small number of parts. All movements are merely sliding and displacing motions which cause little wear, make application of lubricants simple, and ensure a long life span. Lubrication of the lube points at the mandrel head can be done by means of a plug-in distributor head via a grease pump, or by means of an oil mist via rotary supply lines at the mandrel end. It is also possible to cool the expanding segments from the mandrel end from inside.

An example of the invention is illustrated on the drawings as follows:

DETAILED DESCRIPTION OF THE INVENTION

Figure 1:
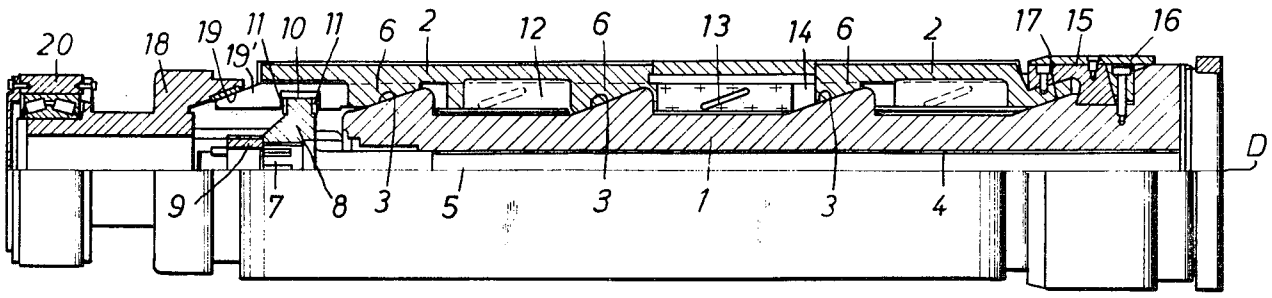
FIG. 1 is a partial longitudinal sectional view of a mandrel reel embodying the invention.

FIG. 1 shows the mandrel reel in a partial sectional view and identifies the mandrel shaft as 1. Distributed over its circumference are several expanding segments 2 supported on several wedge faces 3 rising in the longitudinal direction on the mandrel shaft, with identical opposed wedge faces 6 on the segments. Mandrel shaft 1 is provided with a central bore hole 4 in which the tie rod 5 is axially movable by means of a piston cylinder unit, not shown, engaging the tie rod 5 at mandrel bearing end D.

A star-shaped head piece 8 is slipped on to the end of tie rod 5 facing away from mandrel bearing D, held against rotation by means of a multi-wedge profile, and kept in place by means of shaft nut 9. The star-shaped head piece 8 engages with its star extensions recesses 10 of segments 2, whereby the star extensions allow sliding of segments 11 at the flanks of recesses 10 in radial direction.

At the end near mandrel bearing D, the segments are held by means of removable clamps 15 which, at the side 17 facing the segments, are provided with guide faces in the direction of wedge face 3 so that guidance is given to the segments 2 moving in wedge face direction. The clamps 15 arranged on the circumference of mandrel shaft 1 are in addition embraced by ring 16. The opposite end of mandrel shaft 1 is provided with annular crown or head piece 18 whose inner circumference is provided with guide faces 19 in the direction of wedge face 3, such guide faces 19 opposing identical guide faces 19' arranged on the outer circumference of segments 2, so that segments 2 are displaceable in the direction of wedge faces 3 as well as guarded against centrifugal force at this end of the mandrel shaft as well. If necessary, crown piece 18 may be equipped with an additional step bearing, as shown on FIG. 1 at 20.

Between crown piece 18 and clamps 15 along mandrel shaft 1, springs 13 are inserted into the latter, arranged in the direction of wedge faces 3, such springs 13 reaching into corresponding recesses on the segments, and holding them against centrifugal force displaceable in the direction of wedge faces 3. The arrangement of these springs 13 is shown in FIG. 3.

Figure 2:
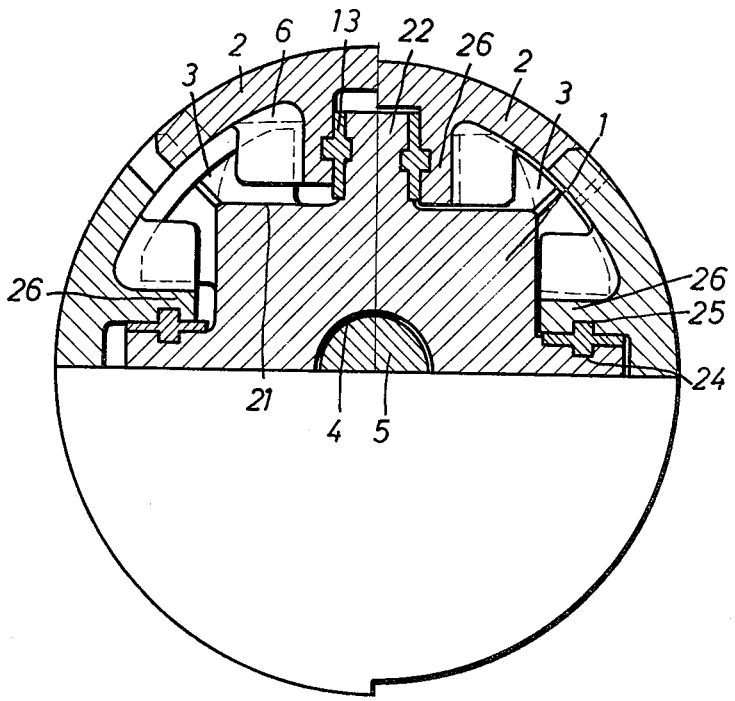
FIG. 2 is an enlarged view in cross section of the reel of FIG. 1 showing the segments expanded in the left hand portion, and retracted in the right hand portion thereof.

Identical parts are identically marked in FIG. 2. The left portion of the mandrel is drawn in expanded position, the right portion of the drawing shows the illustrated segments not expanded. FIG. 2 shows the cross section of mandrel shaft 1, whereby the extensions forming the fins along the mandrel shaft 1 are numbered 22. These extensions are embraced by extensions 26 of segments 2 designed with forked recesses. Extensions 22, 26 of the segments 2 and shaft 1 are provided with spline-shaped accommodations 24, 25 for springs 13 which simultaneously catch the fin-shaped extensions 22 of mandrel shaft 1, retaining the segments in displaceable fashion along splines 24, 25. The example shown on the drawing make each spring 13 part of a wear-resistant plate 12 consisting of a special bronze, for guiding segments 2.

Figure 3:
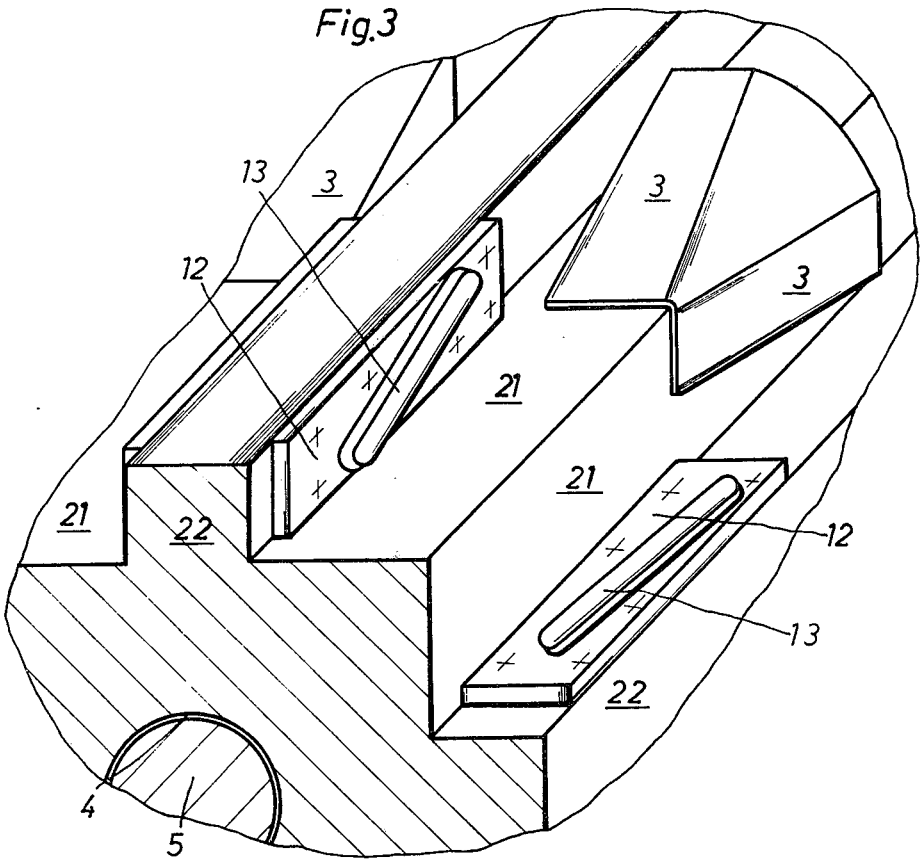
FIG. 3 is an enlarged detailed partial perspective view of the mandrel reel of FIG. 1.

FIG. 3 shows the arrangement of wear-resistant plates 12 at the flanks of extensions 22 forming the fins. Each spring 13 is arranged in the same direction and incline as wedge faces 3 rising from lateral faces 21 of mandrel shaft 1. Each segment 2 is supported on wedge faces 3 and guided on the several spring connections 13 and on the wear-resistant plates 12.

When activating tie rod 5, segments 2 are displaced in axial direction by means of star-shaped piece 8, whereby they move away from the mandrel shaft axis on an inclined plane corresponding to the wedge face incline, while being supported on wedge faces 3 of mandrel shaft 1 and guided along springs 13. Segments 2 are held at their ends additionally by clamps 15 and/or crown piece 18, both permitting simple removal of segments 2 after disassembly. The attachment devices of segments 15 and/or 18 are designed so that displacement of the segments is possible in the direction of wedge faces 3.

We claim:

1. An expandable mandrel reel for coiling strip-like rolling material, particularly hot strip, comprising
   (a) a mandrel shaft;
   (b) a plurality of expandable mandrel segments disposed along said shaft;
   (c) a tie rod axially displaceable in said shaft and connected to said segments;
   (d) a plurality of cooperating opposed wedge faces disposed between said shaft and said segments;
   (e) said faces inclined from the axis of said shaft in the longitudinal direction thereof; the improvement characterized by
   (f) said shaft being square in cross section;
   (g) each face of said shaft having a centrally disposed rectangular extension extending radially therefrom forming fins;
   (h) each said fin forming a pair of parallel flanks;
   (i) a lateral guide for said segments on each flank of each fin;
   (j) each said segment having a cooperating recess for engaging said lateral guides;
   (k) the said plurality of cooperating wedge faces for each segment disposed internally thereof;
   (l) the said plurality of cooperating wedge faces for said shaft disposed directly on said shaft; and
   (m) the said wedge faces on said shaft positioned at right angles to said fin flanks.

2. The apparatus of claim 1, further characterized by
   (a) each said lateral guide comprised of a wear-resistant plate.

3. The apparatus of claim 1, further characterized by (a) each said lateral guide includes a spline construction;

(b) the opposed surfaces of each segment recess having a cooperating spline connection; and (c) a spring disposed in each spline connection on each said lateral guide;

(d) each said spring inclined from the axis of said shaft the same amount as said wedge faces for maintaining said segments positioned on said shaft against centrifugal forces.

4. The apparatus of claim 1, further characterized by (a) removable segment clamp bodies positioned at the bearing end of said shaft;

(b) each of said clamp bodies having an inclined opposed wedge face for cooperating with the wedge face of the adjacent end segment on said shaft; and (c) means on each said clamp body allowing relative radial movement between said end segments and said shaft.

5. The apparatus of claim 4, further characterized by (a) a retaining ring embracing said clamp bodies.

6. The apparatus of claim 1, further characterized by the connection between said tie rod and said segments comprising (a) a star-shaped head positioned on the front end of said tie rod;

(b) said star-shaped head having a plurality of radial extensions;

(c) pockets disposed in each segment adjacent said tie rod front end; and (d) said radial extensions engaging said segment pockets.

7. The apparatus of claim 1, further characterized by (a) an annular head piece disposed on the front end of said shaft opposite the bearing end thereof; and (b) said head piece having inclined cooperating wedge faces for engaging the wedge faces of the segments adjacent said head piece.

8. The apparatus of claim 7, further characterized by (a) a step bearing disposed on said head piece on the end thereof opposite said cooperating wedge faces.

9. The apparatus of claim 7, further characterized by (a) said opposed cooperating wedge faces on said head piece, said shaft and said segments are comprised of an antifriction material.

10. The apparatus of claim 4, further characterized by (a) said opposed cooperating wedge faces on said clamp bodies, said shaft and said segments are comprised of an antifriction material.

* * * * *